US005685542A

United States Patent [19]

Weis

[11] Patent Number: 5,685,542

[45] Date of Patent: Nov. 11, 1997

[54] TENNIS TEACHING APPARATUS

[76] Inventor: Raymond P. Weis, 404 14th St. SE., Austin, Minn. 55912

[21] Appl. No.: 258,825

[22] Filed: Jun. 13, 1994

[51] Int. Cl.[6] ..... A63B 61/00

[52] U.S. Cl. ..... 273/29 A; 273/26 R

[58] Field of Search ..... 273/29 A, 26 R, 273/26 E, 35, 185 D, 184 B

[56] References Cited

U.S. PATENT DOCUMENTS

| | | | |
|---|---|---|---|
| 1,962,087 | 6/1934 | Cone | 273/26 |
| 2,272,765 | 2/1942 | Beeson et al. | 273/29 |
| 2,578,313 | 12/1951 | Moseley | 273/29 |
| 2,713,487 | 7/1955 | Jaediker | 273/29 |
| 3,731,926 | 5/1973 | Vincent | 273/26 E |
| 3,794,320 | 2/1974 | Salmont | 273/29 A |
| 3,866,912 | 2/1975 | Scainetti | 273/29 A |
| 3,876,203 | 4/1975 | Gold | 273/29 A |
| 3,924,853 | 12/1975 | Schleeger | 273/29 A |
| 4,042,237 | 8/1977 | Moraru | 273/29 A |
| 4,089,521 | 5/1978 | Berst et al. | 273/29 A |
| 4,204,678 | 5/1980 | Weis | 273/29 A |
| 4,531,734 | 7/1985 | Herrick | 273/29 A |
| 4,911,442 | 3/1990 | Monroe et al. | 273/29 A |
| 4,989,867 | 2/1991 | Herrick | 273/29 A |
| 5,203,558 | 4/1993 | An | 273/29 A |
| 5,386,988 | 2/1995 | Sung | 273/29 A |
| 5,393,050 | 2/1995 | Lloyd | 273/29 A |

FOREIGN PATENT DOCUMENTS

| | | | |
|---|---|---|---|
| 2548914 | 1/1985 | France | 273/29 A |
| 8704635 | 8/1987 | WIPO | 273/29 A |

*Primary Examiner*—Theatrice Brown

[57] ABSTRACT

The present invention provides an apparatus useful in teaching tennis skills to a player and has a wand having a tennis ball attached thereto pivotally mounted on a base so as to flex when the ball is struck by a tennis racket and also has a damper assembly extending between the wand and the base so as to rapidly damp out oscillations of the wand due to the tennis ball being struck by a tennis racket.

36 Claims, 7 Drawing Sheets

FIG. 1

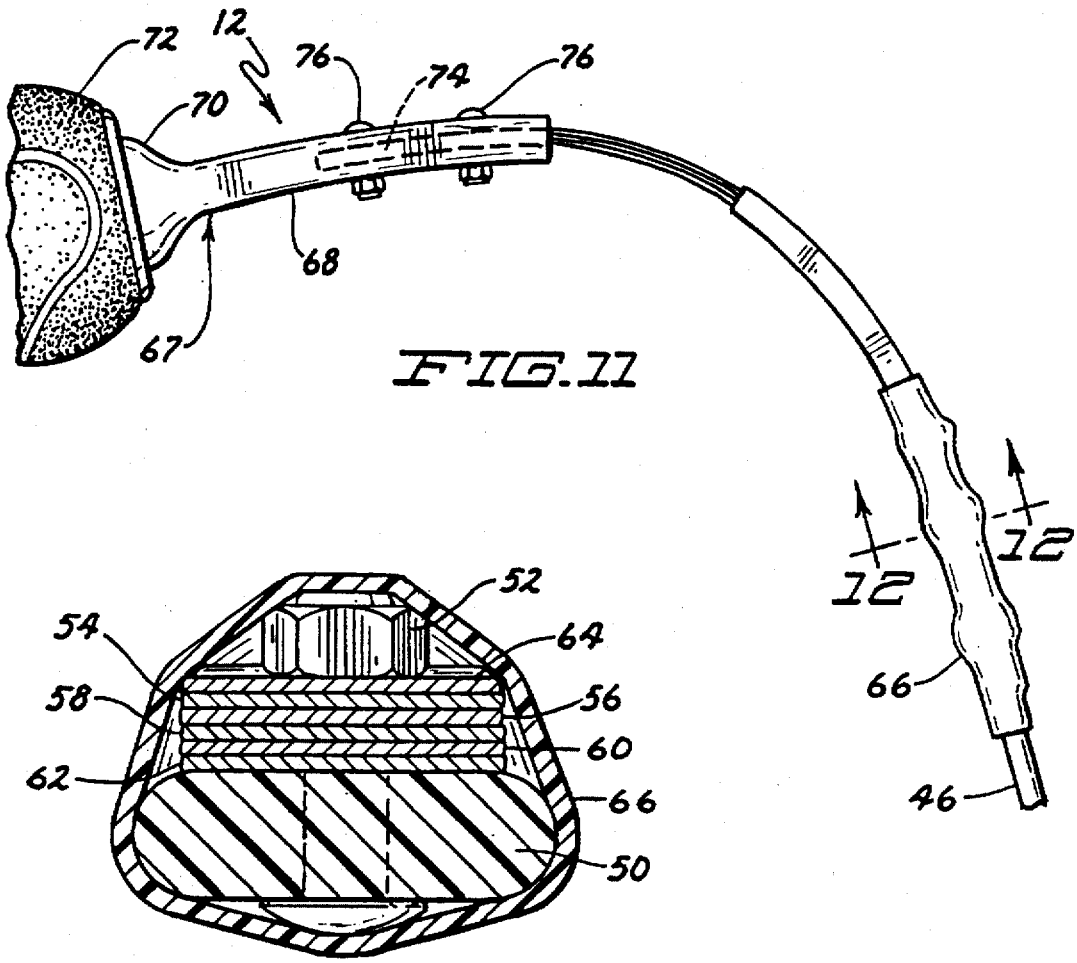
FIG. 11
FIG. 12
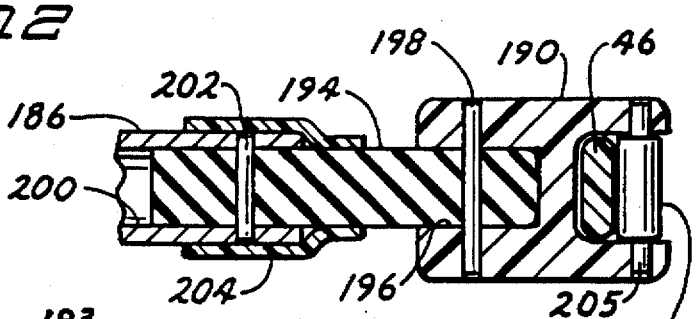
FIG. 10
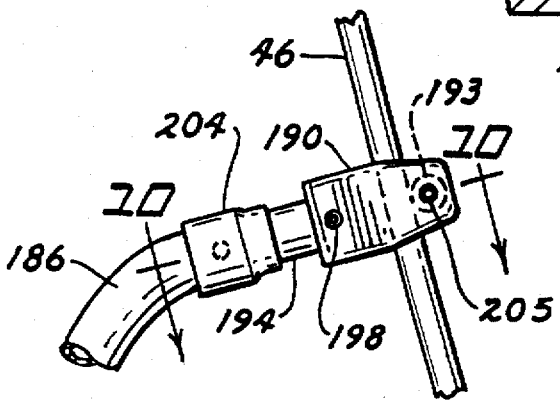
FIG. 9

TENNIS TEACHING APPARATUS

The present invention relates generally to self-help sports teaching apparatus and in particular to such apparatus useful in teaching and improving tennis playing skills.

BACKGROUND OF THE INVENTION

It is has been known for many years to provide an apparatus usable by an individual to improve his skill at playing tennis. Such an apparatus is typically useful in a small area and comprises in general a tennis ball attached in some fashion to the end of a pole that is mounted to a base. Upon striking the ball with a tennis racket, the pole is moved from an initial rest position to a second displaced position. The pole eventually returns to its initial position so that the ball may be struck again. In this manner, a person is able to practice one particular stroke repeatedly and thus is able to improve his skill at making that particular stroke.

The presently available devices are subject to several problems that limit their potential usefulness as a training apparatus, however, and that have limited their potential commercial success as a result thereof. One of those problems is that the presently available devices do not provide the "feel" of an actual tennis ball. That is, in part because the balls are rigidly mounted to the pole, the ball does not respond to being struck by the tennis racket in the same manner as would a ball encountered under actual playing conditions. As a result, the tennis player is unable to practice a proper follow-through. These devices enable a tennis player to practice setting up of a shot and beginning a return volley, but do not enable them to realistically practice their shot from the moment of ball contact through the end of their swing. The training value of these devices is thus tempered by the artificiality introduced into the training experience by their failure to simulate adequately a complete, real-life, return volley of an unencumbered tennis ball.

Another problem with these devices is that they are typically incapable of imitating a variety of incoming tennis shot velocities. That is, they are often constructed such that only a single velocity is simulated thereby. In order to utilize these devices in a training program, then, a large number of devices—one for each incoming velocity simulated—would be needed. In a budget conscious athletic department or athletic club, the cost of acquisition of the devices needed to provide a realistic playing experience is prohibitive and leads to a reluctance to make even an initial purchase of a single device.

A further problem associated with these devices is that many of them do not rapidly damp the oscillations of the pole as it returns to its initial position from its displaced position. Consequently, a player cannot practice a second tennis stroke with any rapidity, which leads to a frustrating and wasteful use of often limited practice time. This inefficient use of time further weakens the commercial market for those devices. Furthermore, some aspect of learning tennis skills well is to practice the same shot or volley repeatedly so as to provide a tennis player with memory training of the player's musculature. That is, by repeatedly practicing the same shot, the tennis player "teaches" his muscles and brain to respond faster than would normally be expected. This practice function is frustrated by presently available devices since the tennis player must wait for the oscillations of the struck target to die out before again being able to swing at the target.

In sum, even though these devices are usable by a tennis player to practice his strokes, they are generally inefficient at teaching the tennis player proficiency in playing the game of tennis. It would be desirable, therefore, to provide an apparatus for efficiently training a person how to play the game of tennis wherein the apparatus is capable of simulating a variety of incoming tennis shots. Additionally, it would be desirable to have a device that would provide relief from tension and stress, exercise, rehabilitation, and aerobic benefits.

OBJECTS OF THE PRESENT INVENTION

It is a principle object of the present invention to provide new and improved apparatus that is not subject to the foregoing disadvantages.

It is another object of the present invention to provide a new and improved tennis playing apparatus useful in helping a tennis player improve his skills in playing the game of tennis.

It is yet another object of the present invention to provide a new and improved tennis playing apparatus that is capable of realistically simulating a plurality of incoming tennis shots.

It is a further object of the present invention to provide a new and improved tennis playing apparatus that enables a tennis player to utilize available practice time efficiently by providing a rapid damping of target oscillations and consequently by enabling multiple hits to be made within time frames similar to those encountered under actual playing conditions.

It is still yet another object of the present invention to provide a method of training a person to play tennis utilizing the new and improved apparatus disclosed herein.

It is another object of the present invention to provide a device for exercise and tension and stress relief.

It is still another object of the present invention to provide a device usable by physically challenged individuals, such as someone confined to a wheel chair, for rehabilitation.

SUMMARY OF THE PRESENT INVENTION

The foregoing enumerated objects of the present invention are accomplished by providing a tennis skill development, teaching, and training apparatus wherein a base supports a flexible wand having a target unit that includes a target means such as a tennis ball attached thereto. The wand is capable of flexible movement between a rest position and a displaced position in response to the target unit being struck by a tennis racket. The wand of the present invention provides a realistic simulation of the feel of a free or unencumbered tennis ball, thereby providing a tennis player with a substantially true-to-life playing experience.

In a representative embodiment, the present invention further provides a damper assembly that includes a damper arm or post whose lower end is also carried by the base. The damper assembly includes a wand receiver formed of a pliant material joined to the upper end of the post. The aforesaid damper assembly rapidly diminishes the oscillations of the wand following a hit so as to quickly present a tennis player with a target for subsequent and repeated practice hits, resulting in a realistic practice experience and an efficient use of practice time. The wand receiver may be formed as a flexible collar that slidingly receives the wand. The damper assembly includes a damper arm that engages the wand at one end and is pivotally anchored to the base at the other end. A biasing apparatus partly in the form of a gas piston is attached to the pivotally anchored end and functions to damp the oscillations of the wand.

The base is constructed such that the wand and the damper assembly can be pivoted or rotated relative thereto so as to vary the height of the target above the playing surface. The base in turn is mounted to a foundation unit that may be filled with sand, water or the like so as to make the tennis skill development aid substantially immobile and therefore resistant to movement along a playing surface due to the force of a player striking the target means.

The foregoing objects of the present invention, as well as others not explicitly set forth, will become apparent to those skilled in the art when the following detailed description of the invention is read in conjunction with the accompanying drawings and claims. Throughout the drawings, like numerals will refer to similar or identical parts.

BRIEF DESCRIPTION OF THE DRAWINGS

FIG. 9 shows the sliding attachment collar between the wand and the damper arm.

FIG. 10 is a cross sectional view of the sliding connection between the wand and the damper arm taken along cutting plane 10—10 of FIG. 9.

FIG. 11 illustrates the upper wand of the present invention with the attached stem to which the tennis ball is attached.

FIG. 12 is a cross sectional view taken along cutting plane 12—12 of FIG. 11 of the attachment of the upper shaft portion of the wand with the strips of spring steel.

DETAILED DESCRIPTION OF THE PRESENT INVENTION

Figure 1:
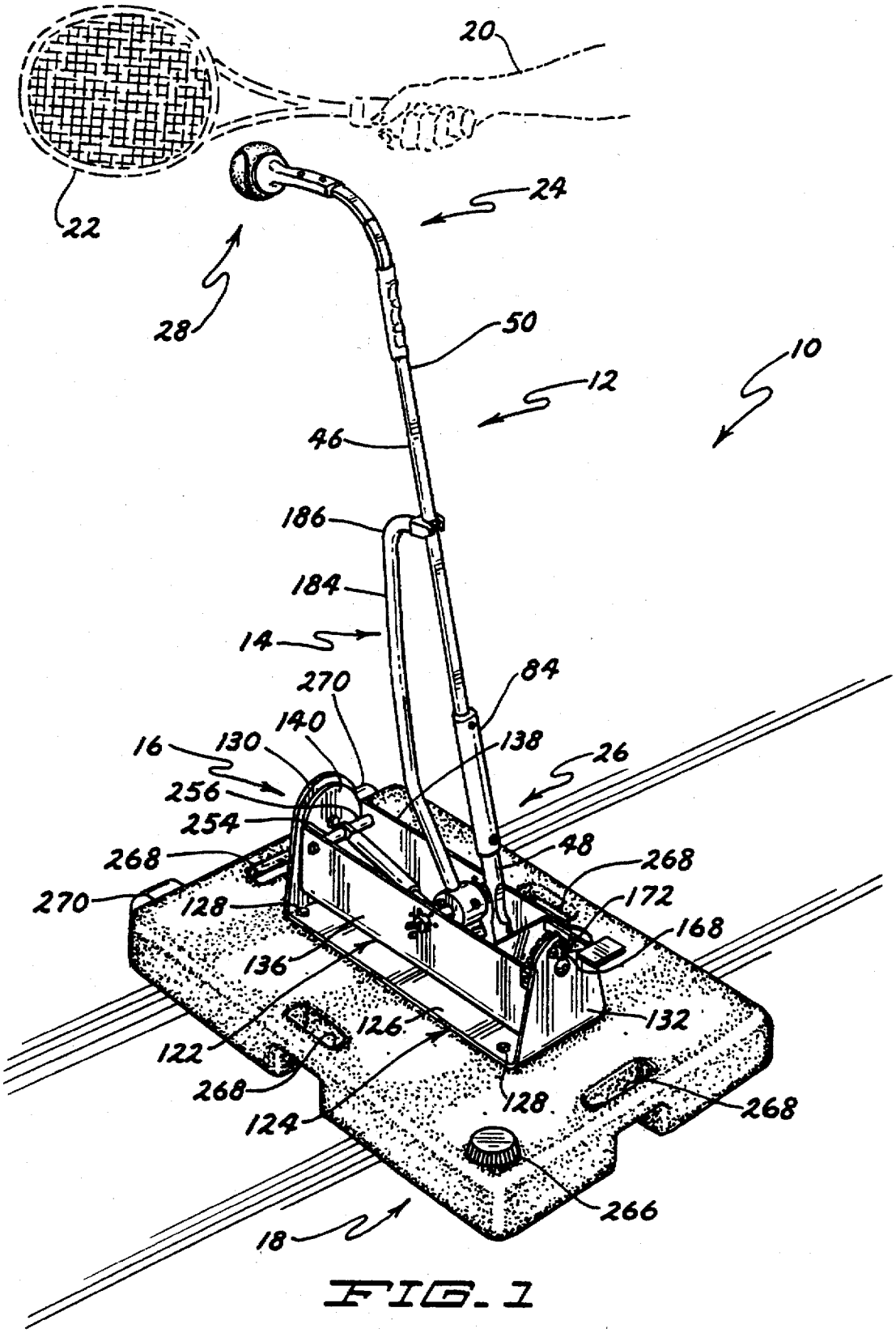
FIG. 1 illustrates an embodiment of the present invention in a perspective view relative to a tennis racket shown in phantom outline.

There is shown in FIGS. 1–13 and hereafter described an exemplary embodiment of a tennis playing apparatus 10 in accord with the present invention. Apparatus 10 includes a wand 12 and a damper assembly 14, both of which are carried by a base 16 that is in turn attached to a foundation 18. As will be described below, apparatus 10 is capable of simulating a plurality of incoming tennis shots of varying heights and velocities, thus providing a tennis player with the opportunity of practicing a variety of tennis strokes. Apparatus 10 is shown relative to the arm 20 of a tennis player swinging a tennis racket 22, both of which are depicted in phantom lines. Wand 12 has an upper section 24 and a lower section 26. Wand upper section 24 carries a target unit 28 as will be fully explained below. Wand lower section 26 is carried by base 16 in a manner to be subsequently described. In the following discussion, "forward" will refer to a direction from the damper assembly 14 toward the wand 12 and "backward" will refer to the reverse direction. Similarly, "front" will refer to the end of the apparatus 10 closest to wand 12 while "rear" will refer to the end of the apparatus 10 closest to the damper assembly 14.

Figure 2:
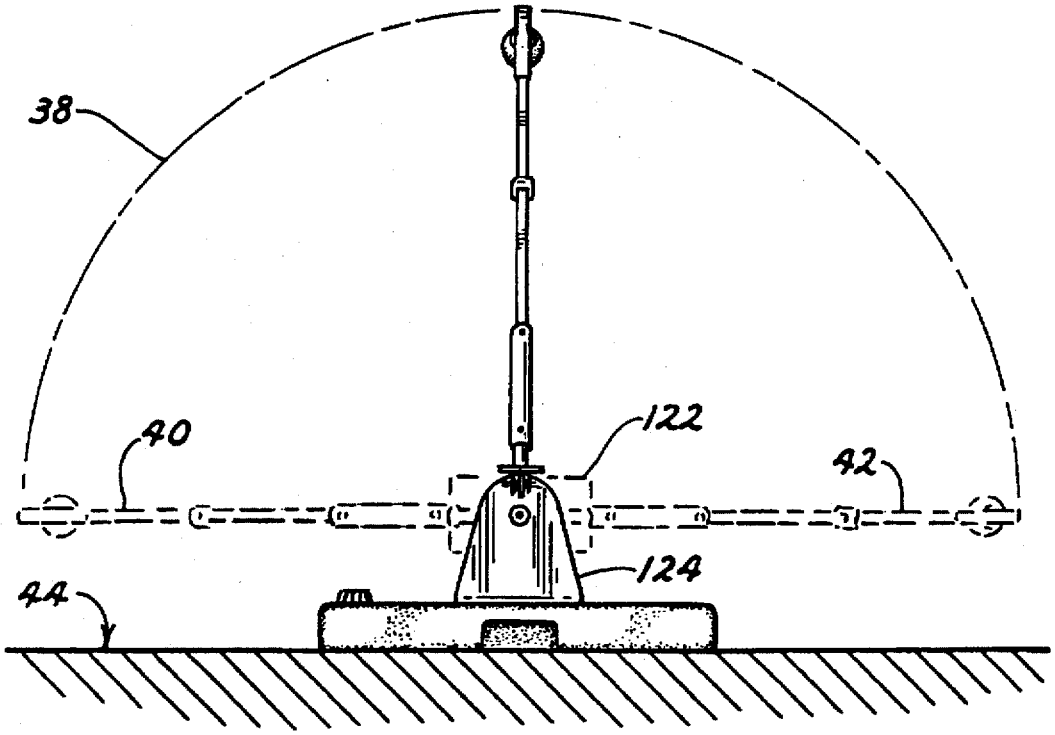
FIG. 2 is a front elevation view of the embodiment shown in FIG. 1 showing the pivotal range of the invention.
Figure 3:
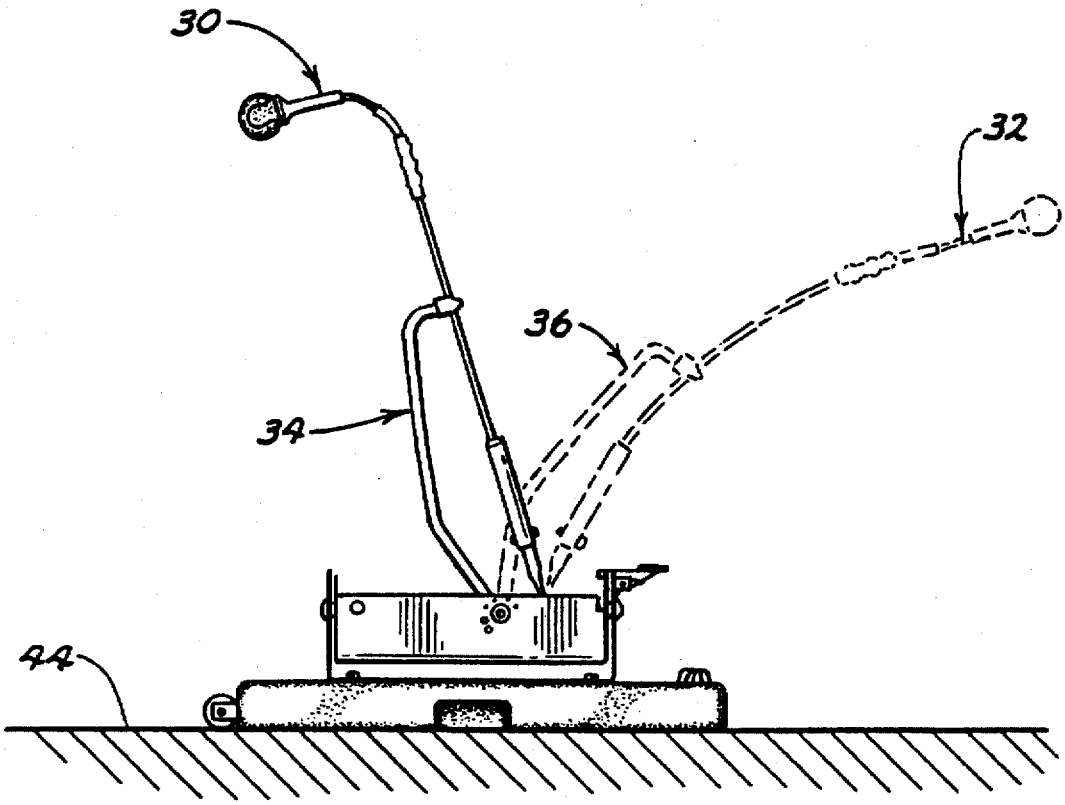
FIG. 3 is a side elevation view of the embodiment shown in FIG. 1 showing the movement of the target between its rest position and a displaced position in response to the target being struck by a tennis racket.

Referring now to FIGS. 1–3, the motions of apparatus 10 will be briefly described. FIG. 3 illustrates the range of motion that is available to the wand 12. It will be seen in reference to the Figures that wand 12 is capable of moving from a rest position 30 to a displaced position 32 shown in phantom outline in FIG. 3 forward of the rest position 30 in response to the impact of the tennis racket 22 on the target unit 28. As 12 moves from rest position 30 to displaced position 32 damper assembly 14 will be carried therewith from its rest position 34 forward therefrom to a displaced position 36 as shown in phantom outline. Referring now to FIG. 2, it will be seen that apparatus 10 provides the capability of pivoting wand 12 substantially through a one hundred eighty degree (180°) are indicated by reference numeral 38 between opposing substantially horizontal orientations 40 and 42 shown in phantom outline. That is, the present invention provides the operator of apparatus 10 with the capability of disposing wand 12 at a desired angular orientation relative to foundation 18 so as to simulate incoming tennis shots of a variety of heights relative to the playing surface 44. Both of these ranges of motion will be explained in greater detail below. In addition, a third range of motion relating to the wand will be described.

Wand 12 will now be further described with reference to FIGS. 1, 7–8, and 11–13. Wand 12 includes a shaft 46 and a shank 48. Shaft 46 may be manufactured from a fiber reinforced thermoset resin whereas shank 48 may be formed of a synthetic material such as urethane and may include a core (not shown) of the same material as the shaft 46. That is, shank 48 may comprise a core material of a similar configuration (other than length) as the shaft 46 with a urethane outer covering. Shaft 46 has an upper end 50 that is fixedly, but removably, attached, such as by nuts and bolts 52, to a plurality of layers of spring steel, 54, 56, 58, 60, 62, and 64. A flexible sleeve 66 is wrapped around the attached upper wand end 50 and spring steel layers 54–64. As shown, six such facially engaged layers or strips of spring steel are attached to the upper shaft end 50. Layers 54–62 extend outward from sleeve 66 while layer 64 does not and is provided for additional strength and flexibility at this connection.

The spring steel strips 54–62 are attached to the target unit 28. Target unit 28 includes a stem 67 comprising a neck 68 and a cup 70 that is attached to a tennis ball 72. Neck 68 includes a passage 74 shown in phantom outline that receives the ends of the spring steel strips 54–62. The ends of the steel strips are fastened within passage 74 by fasteners such as nut/bolt combinations 76, which extend through appropriate through holes (not shown) in neck 68 and through the steel strips 54–62, thereby enabling rapid replacement of the target unit 28 when a tennis ball 72 becomes worn out from use.

Figure 13:
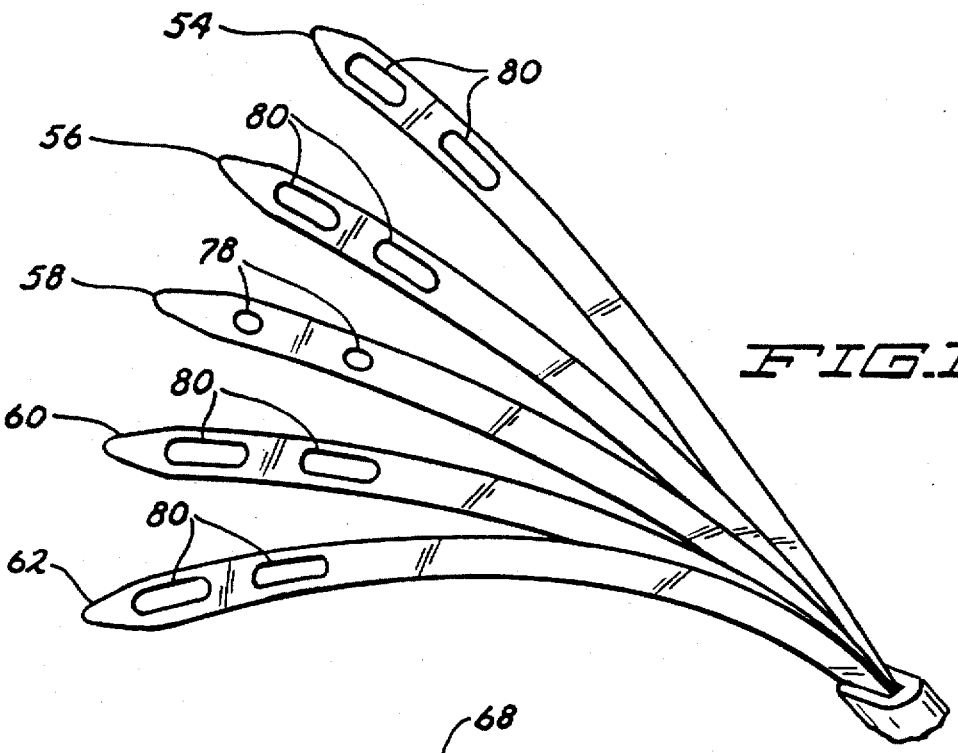
FIG. 13 shows the strips of spring steel shown in FIG. 12 flared apart from each other to show the ends thereof where they are attached to the neck of the stem.
Figure 14:
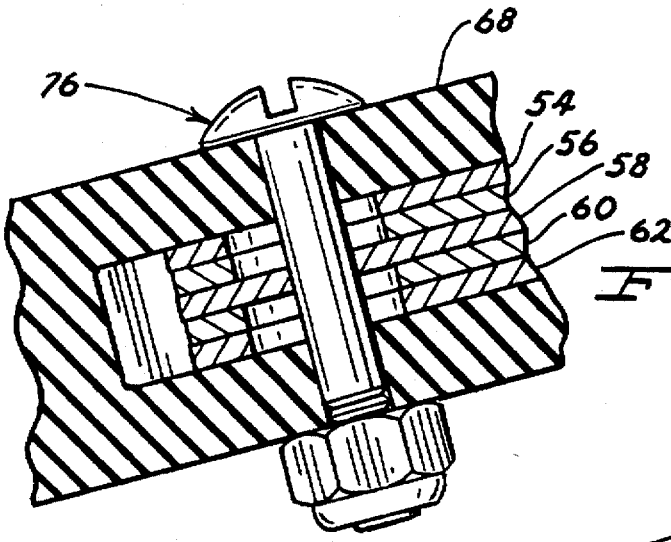
FIG. 14 illustrates a cross sectional view of the spring steel strips in the relaxed or rest position.
Figure 15:
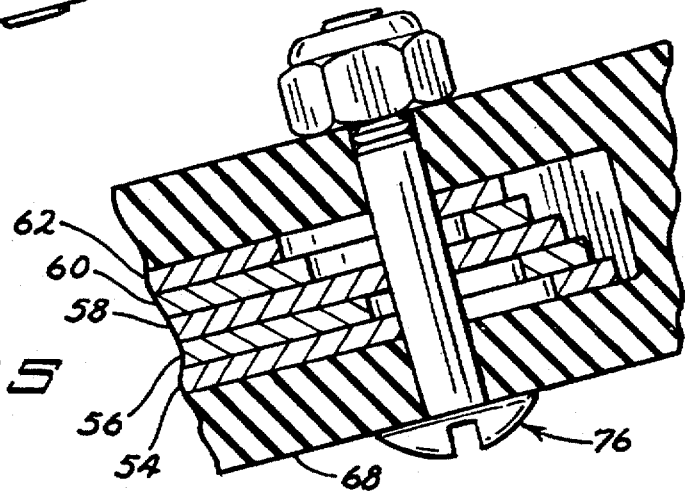
FIG. 15 shows a cross sectional view of the spring steel strips during a displacement of the wand due to the target unit being struck with a tennis racket.

As seen in FIGS. 13 and 14, center strip 58 includes a pair of through holes 78 while outer strips 54, 56, 60, and 62 each include elongate through slots 80 that receive the bolts of the nut/bolt fasteners 76. In this manner, the ends of strips 54, 56, 60, and 62 are able to slide relative to center strip 58, thereby preventing binding of the strips when tennis ball 72 is struck by a tennis racket 22. That is, the slots provide for longitudinal movement of the off-center strips 54, 56, 60, and 62, relative to the center strip 58. FIGS. 14 and 15 illustrate this movement. FIG. 14 shows the alignment of the strips 54–62 within passage 74 of neck 68 when the wand is in the rest position shown in FIG. 1. FIG. 15 shows how the spring steel strips slide relative to each of the bolts 76 when the wand has been moved to its displaced position 32 as shown in FIG. 3. This movement, as noted, prevents binding and provides a more realistic feeling to the user of the apparatus. Thus, the relative motion of the strips aids in giving the user the feeling of striking a "five" tennis ball with a tennis racket. It will be observed that five strips of facially engaged spring steel are shown in the Figures, though it will be understood that more or less may be used depending on the strength of the spring characteristic of the particular spring steel used and the flexibility desired between the target unit 28 and the upper end 50. Thus, the apparatus 10 includes at least three strips of spring steel comprising a center strip and at least two off-center strips lying on each side of the center strip. Preferably the center strip of spring steel will include a pair of spaced apart through holes and the remaining strips will include a pair of spaced apart elongate slots, the slots and the through holes in the strips receiving a bolt shaft of a bolt used to fasten the strips to the neck of the target unit.

Preferably target unit 28 is manufactured from a material manufactured by Anderson Development called 80-5 by it. The use of this material enables the tennis ball 72 to be molded directly to the cup 70 as the target unit 28 is molded. Thus, no adhesives are necessary to attach the ball to cup and manufacturing costs associated with the present invention can be reduced.

Figure 7:
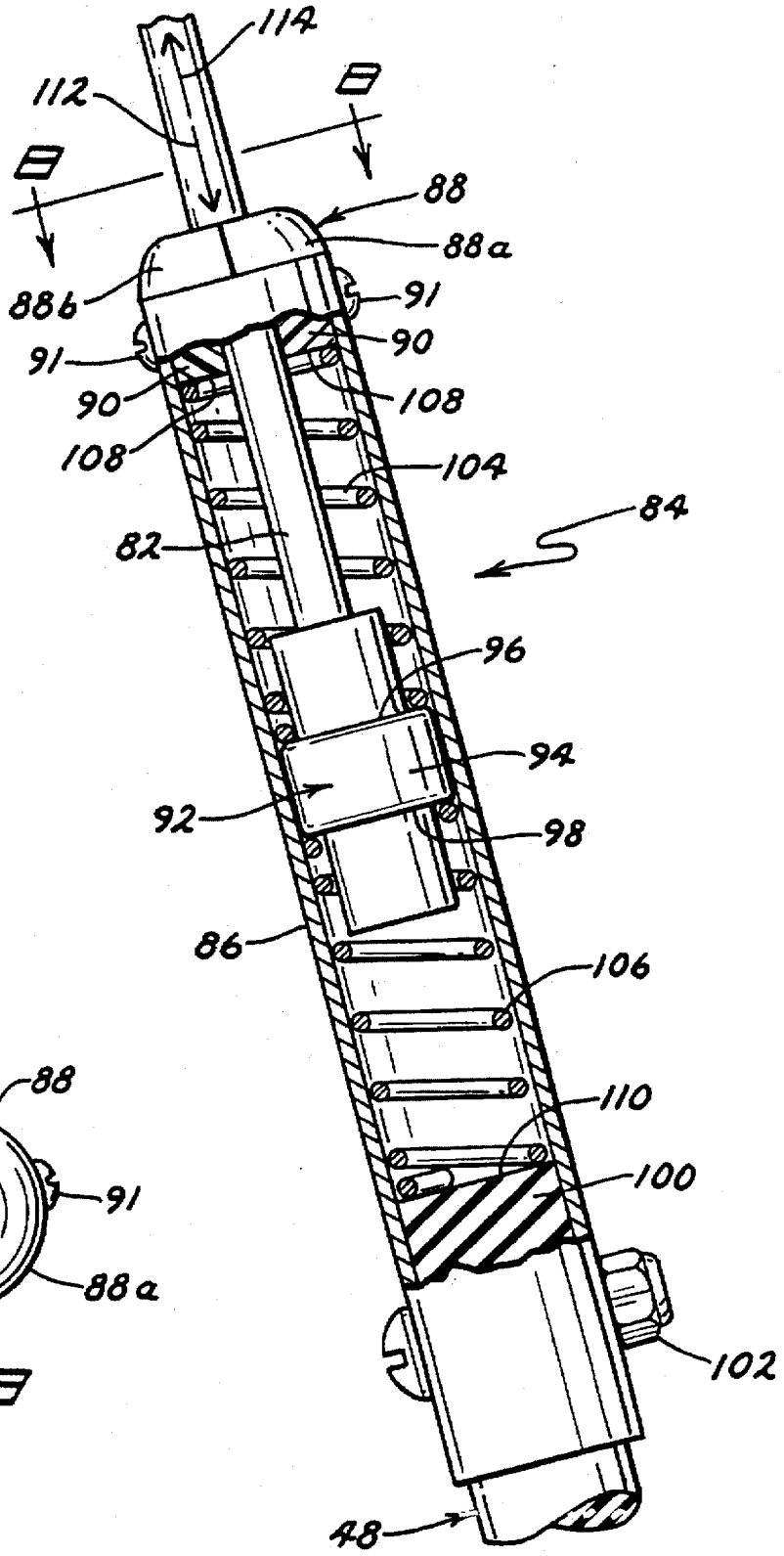
FIG. 7 is a cross sectional view of the wand shock absorber apparatus.
Figure 8:
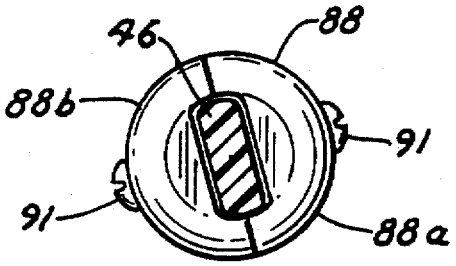
FIG. 8 is a view of the wand taken along viewing plane 8—8 of FIG. 7.

Wand 12 may include a biasing mechanism to enable shaft 46 to move longitudinally with respect to shank 48, which further facilitates the simulation of real tennis play. Referring now to FIGS. 1 and 7 primarily, it will be seen that shaft 46 includes a shaft lower end 82 that is received within a shock body 84. Shock body 84 comprises a tubular member 86 having an end cap 88 comprised of end cap halves **88*a* and 88*b*. Each end cap half 88*a* and 88*b* has an insert portion 90 that is received by tubular member 86. Each end cap half 88*a* and 88*b* is appropriately recessed so as to define a slot for the sliding motion of the shaft 46 relative thereto. The end cap halves 88*a* and 88*b* may be held in place relative to tubular member 86 by appropriate fasteners such as the screws 91 shown in FIGS. 7 and 8. Shaft lower end 82 is attached to a collar 92. Collar 92 has a substantially cylindrical rod-like configuration and includes a centrally disposed shoulder 94 that provides upper and lower bearing surfaces 96 and 98. Shoulder 94 has a diameter substantially equal to the inner diameter of tubular member 86 so as to facilitate an easy sliding motion relative thereto. As described, collar 92 may be a single piece of material, or if desired, the lower end of wand shaft 46 may be dipped in an appropriate synthetic material to form a cylindrically shaped bottom end plug over which a separate ring of material is positioned so as to form the shoulder 94. While the structure of shock body 84, collar 92 and shoulder 94** has been described as substantially cylindrical, it will be understood that they could assume other configurations and that such other configurations are within the scope of the present invention.

The lower end of tubular member 86 receives the upper end 100 of shank 48 and is affixed therein by a nut/bolt fastener 102. Preferably, then, the upper end 100 of shank 48 is configured to be snugly received by tubular member 86. To provide for the absorption of a portion of the force of a blow from a tennis racket 22 striking the tennis ball 72, shock body 84 includes first and second springs 104 and 106, which allow wand 12 to move downward relative thereto. First spring 104 is disposed between the lower ends 108 of the end cap insert portions 90 and the shoulder bearing surface 96. Second spring 106 is disposed between the upper end surface 110 of shank 48 and the shoulder bearing surface 98. As disposed, each spring may, if desired, be slightly compressed though such compression is not necessary to the functioning of the present invention. Thus, the first and second springs bias the wand shaft 46 into a rest position relative to the wand shank 48.

When tennis ball 72 is struck by tennis racket 22, some of the force imparted to target unit 28 and thus wand 12 will be directed upwardly from its rest position to an upwardly displaced position as indicated by arrow 114. While it is possible to strike tennis ball 72 such that it receives a downwardly directed force, normally this particular stroke will not be practiced since hitting a ball downwardly in most instances would cause the ball to strike the net on the tennis court. Thus, even where target 72 is struck so as to provide a top spin (top or, forward english) or a bottom spin (reverse english or a "cut shot), in most instances the ball will be hit upwardly so as to be certain the ball will clear the net. This upwardly directed force will cause first spring 104 to be compressed, resulting in a biasing force against the further upward motion of the wand shaft 46 and resulting in the decompression (if pre-compressed) of spring 106. When spring 104 experiences its maximum compression as related to the force of the particular blow, it will then expand, bearing against the bearing surface 96 and forcing wand shaft 46 in an downward direction as indicated by arrow 112 and thus re-compressing spring 106. The wand shaft 46 will thus be displaced downward relative to the rest position shown in FIG. 1. Because of the mutual action of springs 104 and 106 the oscillations between the rest position and the displaced positions of wand shaft 46 will be quickly abated without damage to the apparatus 10. Shock body 84 thus enables the shaft 46 and the attached target unit 28 to oscillate in a vertical direction between displaced positions relative to an intermediate rest position.

The biasing mechanism of the present invention, then, is preferably included within a shock body and comprises a spring 106 that extends between the upper end 100 of the shank portion and a bearing surface 98 that is disposed around the lower end of the wand shaft. A second spring 104 extends between another bearing surface 96 disposed above or upwardly from the other bearing surface 98 and the upper end of the shock body. The second spring 104 is disposed around the wand shaft. With such a biasing mechanism, when target unit 28 is struck by a tennis racket 22, shaft 46 will be displaced from its rest position. Spring restoring forces will then act to restore shaft 46 to its equilibrium or rest position. Consequently, shaft 46 will oscillate about its rest position until the oscillations are damped, typically within a relatively short time period. By biasing the wand in the aforedescribed manner, a more realistic training experience will be presented since the biasing action aids in the presentation of the feel of a live ball to the tennis player.

Figure 4:
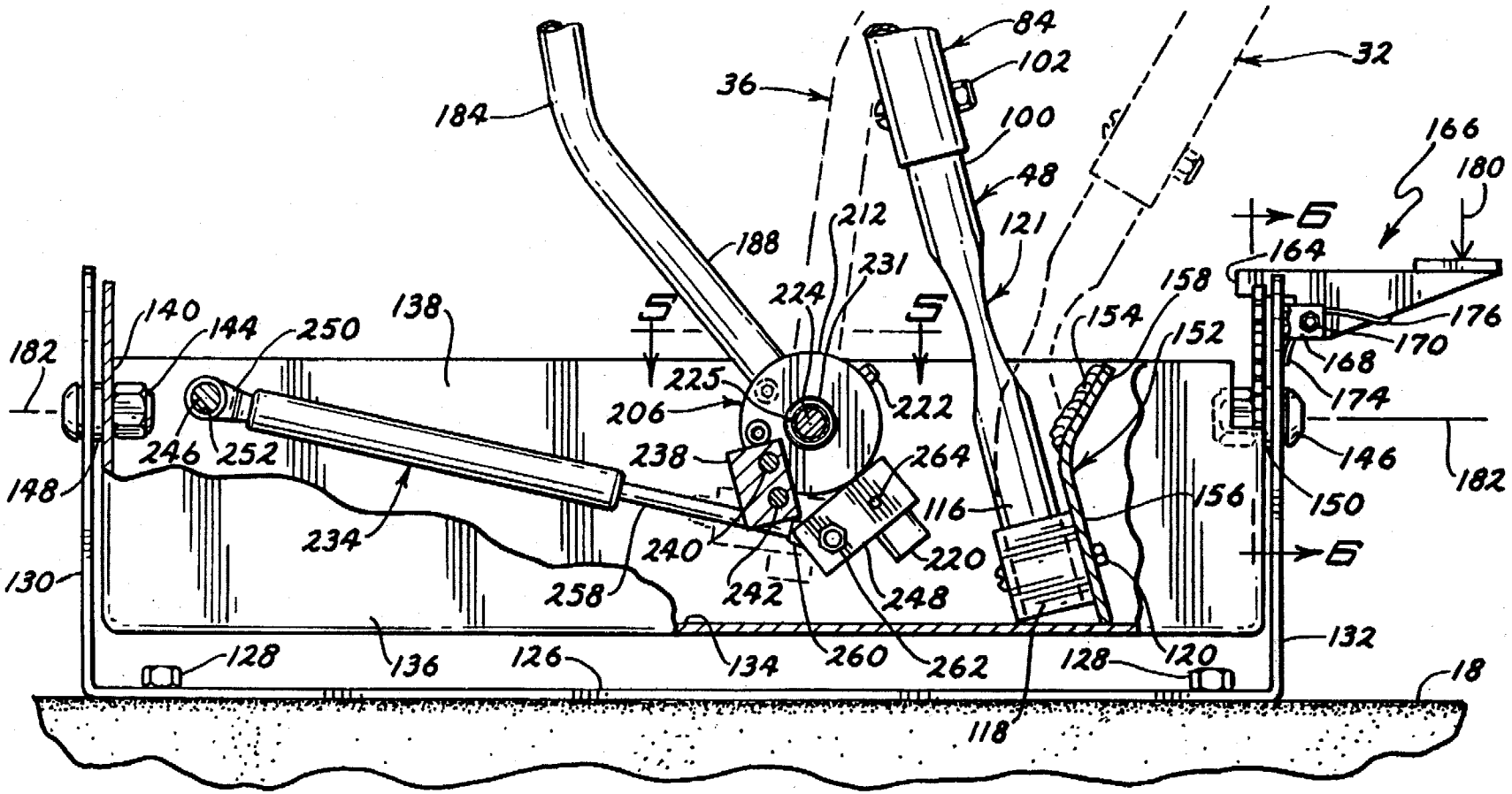
FIG. 4 is a side elevation view, partially in cross section, of the channel showing one embodiment of the manner in which the wand and the damper may be attached to the channel.

As previously noted, shank 48 may be, and preferably is, formed with a core formed from the same material as shaft 46 that is then enveloped in a urethane material. Referring to FIG. 4, it will be seen that the lower end 116 of the shank 48 is received within a tubular member 118 forming part of the base 16 and fastened therein as with fastener 120, which may be a nut/bolt combination with the bolt shaft extending through the lower end 116 of shank 48. Intermediate the upper shank end 100 and the lower shank end 116 is a necked down or "hourglass" shaped portion or joint 121, best seen in FIG. 4. The necked down portion 121 aids in the flexing of the wand 12. Stated otherwise, the wand 12 includes a joint 121 for allowing the wand 12 to flex upon impact of the racket 22 with the tennis ball 72 in the manner of an unencumbered or free tennis ball. A plane is defined by the wand 12 and the damper arm assembly 14 and the joint includes a reduced thickness of pliant material in a direction transverse to said plane to facilitate the wand's ability to flex in the plane defined by the wand 12 and the damper assembly 14 about the necked down portion or joint 121.

All of the various components that make up the wand, i.e., the live tennis ball, the urethane "tip" or stem, the plurality of pieces of spring-steel attached to the fiberglass upper end, the double action of the shock body, and the continuance of the urethane coated fiberglass "wand" molded into an "hour glass" shape which flexes to give an almost perfect circle bend when the ball is hit, function to simulate a tennis ball in free or unencumbered flight.

Base 16 will now be described with reference to FIGS. 1, 2, 4, and 6. Base 16 includes a channel 122 and a pivoting or swivel bracket 124 that pivotally engages channel 122. Bracket 124 is carried by the foundation 18. The pivotal relationship between channel 122 and pivoting bracket 124 enables the range of movement shown in FIG. 2. That is, it is this pivotal relationship that enables the user of apparatus 10 to pivot channel 122 relative to pivoting bracket 124 so as to allow the user to position the tennis ball target 72 at a variety of heights relative to the playing surface 44. Pivoting bracket 124 includes a base plate 126 that is attached to foundation 18 with fasteners 128 such as the bolts shown in the Figures. Pivoting bracket 124 further includes a pair of opposing end walls 130, 132 extending upwardly from base plate 126. Preferably, pivoting bracket 124 is made from a single piece of metal stamped to the appropriate form with the end walls 130, 132 then bent upward to be at a substantially right angle to the base plate 126. As shown in the Figures, end walls 130 and 132 have a somewhat triangular configuration, as best seen in FIG. 1, with a rounded top.

Channel 122 can also be formed from a single piece of metal and then bent to take the form shown in the drawings. As shown, channel 122 has a configuration similar to a box with an open top. That is, it has a bottom 134, a pair of side walls 136, 138 that extend upwardly therefrom at substantially right angles to the channel bottom 134, and a pair of end walls 140, 142 that also extend upwardly from channel bottom 134 at substantially right angles thereto. Channel 122 is pivotally or swivelably hinged to pivoting bracket 124 by means of a pair of fasteners 144, 146, such as the nut/bolt combinations shown, that extend through appropriately configured through holes (not shown) in the pivoting bracket end walls (130, 132) and the channel end walls (140, 142). If desired, appropriate synthetic spacers/bushings 148, 150 may be disposed within the through holes in walls 140, 142 to facilitate the swiveling motion of channel 122 relative to pivoting bracket 124 as well as to space bracket end wall 130 from channel end wall 140 and bracket end wall 132 from channel end wall 142.

Channel 122 also includes a channel brace 152 that extends between channel side walls 136 and 138. Channel brace 152 can be welded as indicated at 154 to the side walls 136 and 138 if desired to rigidly attach it thereto. As shown, channel brace 152 has a lower portion 156 and an upper portion 158. The tube 118 that receives the lower end 116 of shank 48 is attached to the brace lower portion 156 by fastener 120. The upper and lower brace portions 156 and 158 are angularly disposed with respect to each other as best seen in FIG. 4. Thus, the lower portion 156 is disposed at an angle of about seventy five degrees (75°) relative to the channel bottom 134. The angular positioning of the lower channel brace portion 156 thus defines the general angular attitude of the wand 12 to the playing surface 44. This angular disposition may range between about 68° and 76°. The upper portion 158 of the channel brace 152 is disposed so as to extend forward toward the front of the apparatus, that is, toward end wall 142 of channel 122. This forward bending of the upper portion 158 of channel brace 152 provides room for the forward flexing of the wand 12 about its attachment within the wand tube 118 to displaced position 32 as best seen in FIG. 4. As previously noted, this flexing is facilitated by the necked down portion or joint 121 of shank 48.

Figure 6:
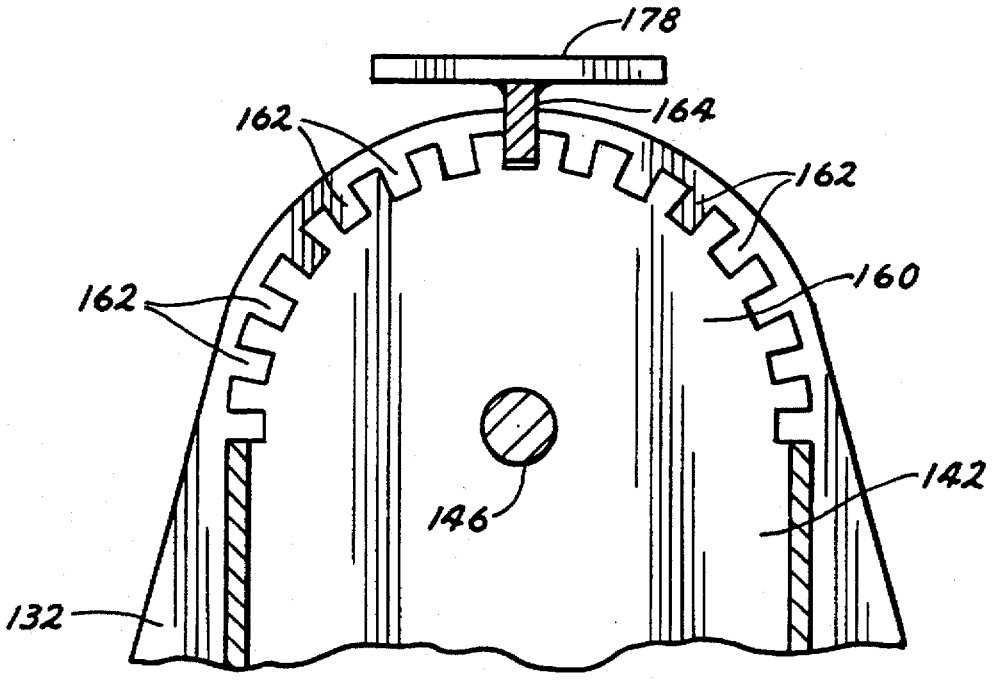
FIG. 6 is a view of the notches in the partially circular end wall of the channel taken along viewing plane 6—6 of FIG. 4.

The channel 122 and the pivoting bracket 124 having now been briefly described, the apparatus for disposing the channel 122 at a particular desired angular relation to the pivoting bracket 124 will now be described with particular reference to FIGS. 1, 4 and 6. Thus, channel end wall 142 includes an upper, substantially semicircular segment 160. Segment 160 includes a plurality of notches 162 cut into the outer edge thereof as best seen in FIG. 6. These notches 162 are appropriately sized and configured to receive the blade 164 of a swivel lock 166. Blade 164 is mounted to pivoting bracket end wall 132 by means of a U-shaped bracket 168 that is attached, such as by welding, soldering or some other known manner, to the pivoting bracket end wall 132. Blade 164 and the arms of the U-shaped bracket 168 each include appropriate through holes (not shown) that receive a bolt 170 such that the swivel lock 166 can pivot relative thereto. Swivel lock 166 further includes a pair of torsion springs 172 (only one of which is shown in the drawings) that are mounted such that the shaft of the bolt 170 extends therethrough. One such spring 172 is mounted on each side of the blade 164 and each extends between the inner surface of an arm of the U-shaped bracket 168 and the blade 164. Each spring has a pair of extended ends 174 and 176, with the end 174 bearing against pivoting bracket end wall 132 and end 176 bearing against blade 164.

The springs 172 are attached in a biased condition so as to bias the blade 164 into engagement with a notch 162. Thus, exerting a downward force 180 on the hand plate 178, which is attached to the blade 164, as indicated by arrow 180, will cause the blade 164 to pivot upwardly around the longitudinal axis of the bolt 170, lifting the end of the blade 164 out of engagement with the notch. When the blade 164 is disengaged from the notch, the channel 122 and attached wand 12 and damper assembly 14 can be rotated relative to the pivoting bracket 124, thereby disposing the tennis ball target 72 at a preselected height for practice by the user. Stated otherwise, fasteners 140 and 146 define a longitudinal axis 182 about which the channel 122 pivots relative to the pivoting bracket to a desired position substantially between the positions 40 and 42 shown in FIG. 2. Exerting the downward force as indicated by arrow 180 will further bias the springs 172 so as to exert a greater restoring force on the blade 164 that is resistant to the pivoting thereof. Releasing the downward force 180 then will allow the springs 172 to pivot the blade 164 back into engagement with one of the notches 162, thereby locking the channel 122 at a predetermined angular position relative to the pivoting bracket 124 and fixing the tennis ball 72 at the desired practice height.

The damper assembly 14 of the present invention will be described now with principle reference being made to FIGS. 1, 4, 5, 9 and 10. The damper assembly 14 includes a damper arm 184, which advantageously may be made of aluminum tubing bent to the desired configuration, having an upper end 186 and a lower end 188. The upper end 186 is engaged with the wand shaft 46 and the lower end 188 is engaged with the base 16; both engagements to be hereafter described. Thus, the damper assembly 14 further includes a damper collar or head 190 having a slot 192 whose open end receives a roller 193 that is rotatably mounted to the damper head 190. Slot 192 and roller 193 are configured to slidingly receive wand shaft 46, thus facilitating the previously described motion of the shaft 46 relative to the shank 48, as well as the motion shown in FIG. 3. Damper head 190 is attached to upper end 186 of damper arm 184, as best seen in FIG. 10, by a plug 194 manufactured preferably of a flexible material. One end of plug 194 is received within an appropriately configured recess 196 in damper head 190 and held therein by a retaining pin 198. The other end of the plug 194 is received within the hollow end 200 of the damper arm 184 and held therein by a retaining pin 202. Flexible connecting plug 194 permits the ball 72 to be hit in any forward direction be it straight forward, left forward, or right forward without causing damage to the wand 12 or the damper assembly 14, Thus, the use of flexible plug 194 enables the user to simulate shots to all corners of a tennis court. If desired, a flexible sleeve 204 may be used to envelop the connection between the upper end 186 of the damper arm 184 and the plug 194. As shown, the plug 194 includes a roller 193 rotationally mounted so as to facilitate the sliding motion of the wand upper 24 within the recess 192. That is, the wand upper will slidingly engage the roller 193, which will roll under the frictional engagement therewith as the wand 12 moves under the influence of a strike on the target ball 72 by a player. Roller 193 may be mounted within slot 192 for rotation by an appropriate pin or axle 205.

Figure 5:
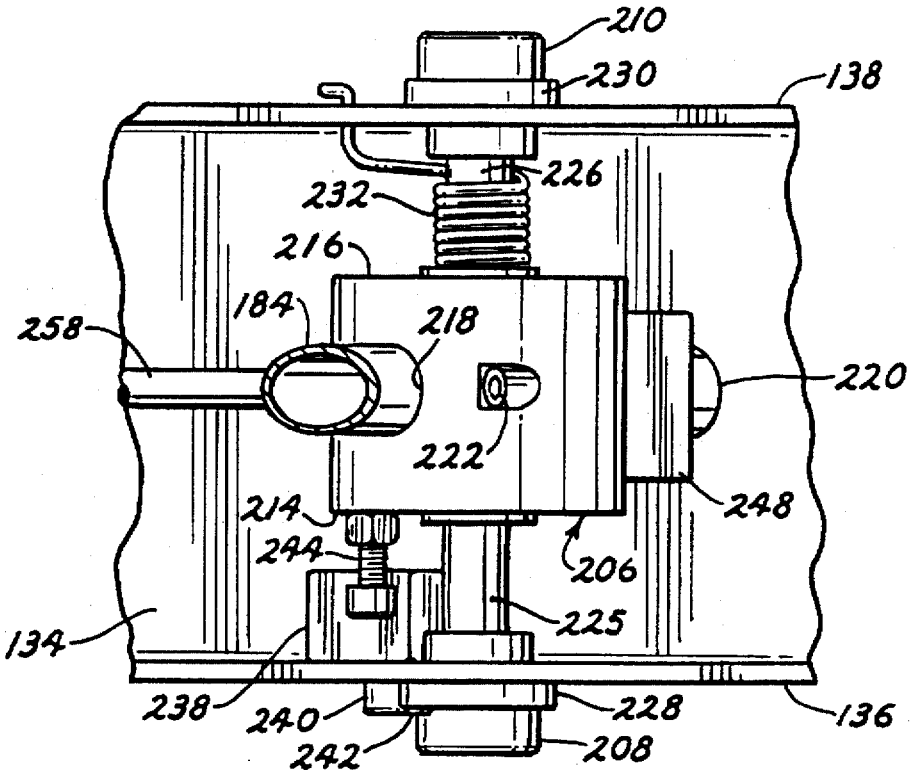
FIG. 5 shows in a top elevation, partially cross sectional view taken along viewing plane 5—5 of FIG. 4, apparatus useful in damping movement of the wand in response to the target being struck by a tennis racket.

Referring now to FIGS. 1, 4 and 5 primarily, the attachment of the damper arm 184 to base 16 will be described. As seen in the Figures, the lower end 188 is received within a damper pivot block 206 mounted within channel 122. The pivot block 206 is mounted for rotation within channel 122 by a pair of socket head bolts 208, 210. That is, pivot block 206 has a substantially cylindrical outer surface 212 and a pair of substantially planar opposing end surfaces 214 and 216. The end surfaces 214 and 216 each have a threaded recess (not shown) to receive the threaded shaft of the bolts 208 and 210 respectively. These threaded recesses do not extend all the way through the pivot block because the lower end 188 of damper arm 184 extends therethrough through a hole 218 such that the bottom end 220 of the damper arm 184 extends therefrom, as best seen in FIGS. 4 and 5. The damper arm 184 is fixed in position relative to the pivot block 206 by means of a set screw 222.

The shaft 224 of bolt 208 is shown in FIG. 4. Bolts 208 and 210 extend through appropriately configured through holes (not shown) in channel side walls 136 and 138 respectively so as to be freely rotatable therein. That is, the through holes should be sized so as to be larger than the bolt shafts so as to allow them unrestricted rotation relative thereto. Each bolt shaft may be inserted within a sleeve 225, 226 disposed around the shafts of bolts 208 and 210 respectively. Sleeves 225 and 226 along with bushings 228 and 230 center pivot block 206 within channel 122. If desired, the shafts of the bolts 208 and 210 may be received by appropriately placed roller bearings 231 in pivot block 206, or may be received by bushings.

As described, damper arm 184 is free to pivot forwardly and rearwardly. To provide a damping effect and to quickly return wand 12 to the rest position, a torsion spring 232 and a gas cylinder 234 are advantageously used. Torsion spring 232 has an end 236 received and retained within a through hole (not seen) in channel side wall 138. If desired, channel side wall 138 may include a plurality of such through holes so as to adjust the predisposed bias of the spring, therefore aiding in the provision of simulation of differing ball velocities. The other end of the torsion spring 232 is received and retained within a hole (not seen) in end surface 216 of pivot block 206. Thus, as damper arm 184 is pivoted forward during the forward motion of the wand 12, pivot block 206 will be rotated in a clockwise direction as viewed in FIG. 4, thereby biasing torsion spring 232 and creating a restoring force urging the pivot block 206 to rotate back to the rest position, and thereby carrying damper arm 184 and thus wand 12 back to their rest positions. To prevent over rotation of the pivot block 206 in the counterclockwise direction and to consistently position the wand for subsequent hits, a stop block 238 is attached to channel side wall 136 on the inside surface thereof in any known manner such as by means of a pair of fasteners 240, 242. A stop arm 244 is attached to the end surface 214 of pivot block 206 so as to extend outwardly therefrom toward channel side wall 136 and is positioned so as to engage stop block 238 at a position of maximum desired rearward positioning of the wand 12. As shown stop arm 244 may be a threaded fastener that threadably engages an appropriate threaded hole in end surface 214 of pivot block 206. If desired, the channel side wall 136 may include a plurality of holes to adjust the position of the stop block 238 as desired.

Gas cylinder 234 extends between a shaft 246, which may be a bolt, and a clevis 248. Shaft 246 extends between channel side walls 136 and 138. Gas cylinder 234 has a cylinder blade 250 including a through hole 252 to receive shaft 246. Appropriate sleeves 254, 256 may be used to center cylinder blade 250 between channel side walls 136 and 138. Gas cylinder 234 includes a piston 258 having a piston blade 260 at the end thereof that is attached to the clevis 248 by means of a fastener 262 such as a nut/bolt combination. Clevis 248 is attached to the portion of damper arm 184 that extends through pivot block 206 and secured thereon with a set screw 264. In operation, as the damper arm 184 is retracted rearward to the displaced position 36 by the action of the wand 12 moving forward under the impact of a tennis racket 22 striking the target unit 28, pivot block 206 will be rotated clockwise as viewed in FIG. 4, biasing torsion spring 232. As damper arm 184 pivots forward, the bottom end 220 thereof will be pivoted backward, thereby forcing piston 258 into the gas cylinder 234, which the gas cylinder will resist in well known manner. The torsion spring 232 will then return the damper arm 184 and wand 12 to their rest positions, causing the bottom end 220 of the damper arm to be pivoted forward, pulling the piston 258 therewith. This action will be resisted by the gas cylinder. Thus, the gas cylinder will act to dampen the motion of the wand and damper arm in both directions of motion while the torsion spring will act to resist the forward motion and to return the damper arm and wand to their rest positions. Together the gas cylinder 234 and the torsion spring 232 act to quickly and consistently return the wand 12 to its rest position with a minimum of residual oscillation. Thus, the wand 12 is quickly positioned for a subsequent strike by the racket 22 within the expected time frame of a return volley in a tennis match.

Referring now to FIG. 1, foundation 18, in its preferred embodiment has a hollow configuration to receive ballast. Thus, foundation 18 includes a fill opening for filling and emptying ballast therefrom and a fill cap 266 which may be affixed to the fill opening to retain the ballast therein. The ballast may include material such as sand, water, or lead or copper shot. The shot would, of course, provide the best anchor, while using water as ballast provides greater flexibility in the use of the present invention. As previously noted, the base 16 may be mounted to foundation 18 by means of fasteners such as the bolts 128 shown in the Figure. Foundation 18 may also include a plurality of hand holds 268 to facilitate carrying or transport of the apparatus 18, and may additionally include a pair of wheels or rollers 270 attached at one end thereof upon which the present invention may be wheeled. Foundation 18 may, if desired, take the form of a metallic plate of sufficient weight that apparatus 10 will not be moved during use by the force of the tennis player's blows on the tennis ball 72.

The ability of the device to simulate a number of shots readily lends itself to a method of training a tennis player using the present apparatus. For example, a plurality of the devices could be situated in desired positions on a tennis court such as near the base line, the net, or intermediate thereof, and the apparatus at each location could be configured to simulate a particular shot. Thus, a player would be able to move from apparatus to apparatus along a particular route and practice a particular type of shot at each location. In this manner, a number of players could quickly and effectively practice a particular shot at a particular location by proceeding serially around a course laid out by the tennis instructor. When the desired number of circuits have been made, the flexibility of the apparatus allows for a new course to be laid out and the same shots to be practiced at a different location, or different shots to be practiced at the same locations as originally established. In this way, a tennis team such as would be found in a high school or college could effectively utilize a small practice area and gain skill in the game of playing tennis.

As a further advantage of the present invention, the foundation may be detached from the base and the base may then be mounted to an appropriate wall mount at a height of about seven feet such that the wand 12 extends outwardly from the wall. In this mounted position, the wand 12 may be pivoted as aforedescribed between a height of about five feet to a height of about nine feet. A player may thus be able to practice hitting a serve with the target ball 72 placed at the desired specific "service" height of the particular player.

The present invention thus provides a device that can be used to improve a player's tennis skills and that can be used to teach the game of tennis. Additionally, because of the rapid return of the wand 12 to its rest position as provided by the damper arm assembly 14, the apparatus 10 can provide exercise and an aerobic benefit to the user. That is, because the target ball 72 can be struck many times in rapid succession, the user can increase his pulse rate and respiration to the point where an aerobic benefit is obtained. The easy adjustability of the height of the wand 12 enables the apparatus 10 to be used by the physically challenged individual who is, perhaps, confined to a wheel chair. Apparatus 10 can also provide a means for relieving tension and stress through the exercise provided thereby as well as the ability to allow the user to repeatedly strike the target tennis ball 72.

Having thus described the present invention, other modifications, alterations, or substitutions may now suggest themselves to those skilled in the art, all of which are within the spirit and scope of the present invention. For example, the apparatus may include a lift means such as a scissors lift attached to the base to selectively elevate the apparatus above the playing surface. In addition, the apparatus may include alarm means for selectively indicating when the tennis ball is struck. It is therefore intended that the present invention be limited only by the scope of the attached claims below.

What is claimed is:

1. A tennis practice apparatus usable by an individual with a tennis racket for practicing his playing skills in hitting a tennis ball, said apparatus comprising:

a base;

a target unit including a target for striking by the tennis racket;

a flexible wand having an upper section and a lower section, said lower section being attached to said base, said wand extending upwardly from said base, said wand being able to move between a wand rest position and a wand displaced position in response to said target being struck by the tennis racket; and means attaching said target unit to said upper section of said wand, said attaching means including a plurality of elongate strips of spring steel, each said strip having front and rear faces, and each said strip having at least one said face engaging a face of an adjacent strip with said strips of spring steel cooperating with said target unit to closely simulate the feel of an unencumbered tennis ball.

2. The apparatus of claim 1 wherein said plurality of strips of spring steel includes at least three strips.

3. The apparatus of claim 1 wherein said plurality of strips comprises an odd number.

4. The apparatus of claim 3 wherein said plurality of strips includes a center strip having a pair of spaced apart through holes and each of said remaining strips include a pair of spaced apart elongate slots, said apparatus further including a bolt having a shaft, said slots and said through holes in said strips receiving said bolt shaft of said bolt to fasten said strips to said target unit, said slots providing for longitudinal movement of said remaining strips relative to said center strip.

5. The apparatus of claim 1 wherein said target unit includes:

said target comprising a tennis ball; and a stem having a cup and a neck, said tennis ball fixedly attached to said cup and said neck comprising an elongate tubular member having a receptacle configured to receive said strips of spring steel.

6. The apparatus of claim 5 wherein said plurality of strips of spring steel includes at least three strips comprising a center strip and at least two off-center strips sandwiching said center strip therebetween and wherein said center strip of spring steel includes a pair of spaced apart, through holes and said remaining strips include a pair of spaced apart elongate slots, said apparatus further including a bolt having a shaft, said slots and said through holes in said strips receiving said shaft of said bolt to fasten said strips to said neck of said target unit, said slots providing for longitudinal movement of said off-center strips relative to said center strip.

7. The apparatus of claim 1 and further including a damper for damping movement of said wand generated by said target being struck by the tennis racket, said damper extending upwardly from said base.

8. The apparatus of claim 7 wherein said damper comprises a damper arm having first and second damper arm ends and further comprises means for pivotally mounting said damper to said base, said first damper arm end being slidably engaged with said wand and said second damper arm end being pivotally mounted to said base by said mounting means.

9. The apparatus of claim 8 wherein said pivotal mounting means comprises:

a pivot block having a first through hole receiving said second damper arm end such that said damper arm extends through said pivot block so that said second damper arm end extends therefrom;

means for rotationally mounting said pivot block to said base.

10. The apparatus of claim 8 wherein said damper further comprises a gas piston, said gas piston including a first end mounted to said base and a second end from which a piston rod extends, said piston rod being connected with said second damper arm end, whereby when said target is struck by the tennis racket said wand will be moved from its rest position to its displaced position and said damper arm will be pivoted about said means for pivotally mounting said damper resulting in said piston rod being retracted.

11. The apparatus of claim 1 wherein said base comprises a channel, said channel mounting said wand for said motion between said rest and displaced positions.

12. The apparatus of claim 11 wherein said channel mounts a damper for damping oscillations of said wand in response to said target being struck by the tennis racket.

13. The apparatus of claim 12 wherein said damper comprises a damper arm having first and second damper arm ends and further comprises means for pivotally mounting said damper to said channel, said first damper arm end being slidably engaged with said wand and said second damper arm end being attached to said means for pivotally mounting said damper.

14. The apparatus of claim 13 wherein said target comprises a tennis ball; and said target unit includes a stem having a cup and a neck, said tennis ball fixedly attached to said cup and said neck comprising an elongate tubular member having a receptacle configured to receive said strips of spring steel.

15. The apparatus of claim 11 wherein said channel has an elongate axis and said base further comprises a pivot bracket mounting said channel for pivotal movement of said channel relative thereto, said pivotal movement of said channel being in a plane transverse to said channel elongate axis, whereby said channel may be selectively pivoted so as to dispose said target at selected heights above a playing surface.

16. The apparatus of claim 15 wherein said channel includes an end wall having a substantially semi-circular top side with a plurality of notches disposed along said top side, and said pivot bracket having an end wall, said pivot bracket end wall having a top, and;

said practice apparatus further includes a latching apparatus for selectively latching said channel in a selected pivoted position relative to said pivot bracket, said latching apparatus including a latch pivotally mounted to said pivot bracket, said latch being pivotable between a latched position wherein said latch engages one of said notches and an unlatched position wherein said latch is disengaged from all of said notches and said channel is free to pivot relative to said pivot bracket.

17. The apparatus of claim 16 wherein said latch apparatus includes a torsion spring for biasing said latch to said latched position, said torsion spring including a first spring end bearing against said latch and a second spring end bearing against said pivot bracket end wall.

18. The apparatus of claim 1 wherein said base comprises a channel, said channel having a substantially open-topped elongate box-like configuration defined in part by a pair of opposed side walls, said base further including a channel brace extending between said side walls and mounting a tubular member, said tubular member receiving said lower section of said wand.

19. The apparatus of claim 18 and further including a fastener for fastening said lower section of said wand within said tubular member and for preventing rotation of said wand relative to said channel.

20. The apparatus of claim 18 wherein said channel brace comprises a first planar brace portion and a second planar brace portion angularly disposed relative to said first planar brace portion and wherein said tubular member is attached to said first planar brace portion, said second planar brace portion being angled away from said wand in the direction of movement from said wand rest position to said wand displaced position.

21. The apparatus of claim 1 and further including a foundation, said foundation having a hollow interior such that said foundation may be filled with ballast, said base being attached to said foundation.

22. The apparatus of claim 21 wherein said foundation includes a foundation side having a handle and further includes roller means for facilitating movement of said apparatus, said roller means disposed opposite said foundation side.

23. A tennis playing apparatus usable by a tennis player with a tennis racket to improve his playing skills in hitting a tennis ball, said apparatus comprising:

a base;

a target unit including a target for striking by the tennis racket;

a flexible wand having an upper section and a lower section, said lower section attached to said base, said wand extending upwardly from said base, said wand being able to move between a wand rest position and a wand displaced position in response to said target being struck by a tennis racket, said wand including a joint for facilitating flexing of said wand about said joint upon impact of a tennis racket with said target so as to closely simulate the feel of an unencumbered tennis ball;

means for attaching said target unit to said upper section of said wand;

said base including a channel, said channel including a pair of opposed sidewalls;

said base including a channel brace extending between said sidewalls and said base further including a tubular member, said tubular member mounted to said channel brace and receiving said lower section of said wand; and said channel brace including a first planar brace portion and a second planar brace portion angularly disposed relative to said first planar brace portion and wherein said tubular member is attached to said first planar brace portion, said second planar brace portion being angled away from said wand in the direction of movement from said wand rest position to said wand displaced position.

24. The apparatus of claim 23 wherein said joint is disposed so as to be closely adjacent said second planar brace portion so as to allow said wand to flex forwardly about said joint and be free of interference with said second brace portion.

25. A tennis practice apparatus usable by a tennis player with a tennis racket to improve his playing skills, said apparatus comprising:

a base;

a target unit including a target for striking by the tennis racket;

a generally upright flexible wand having an upper section and a lower section, said lower section attached to said base, said wand extending upwardly from said base, said wand being able to move between a wand rest position and a wand displaced position in response to said target being struck by the tennis racket;

means attaching said target unit to said upper section of said wand; and a damper for damping movement of said wand generated by said target being struck by the tennis racket, said damper extending upwardly from said base and including a substantially rigid damper arm having first and second damper arm ends and further including means for pivotally mounting said damper to said base, said first damper arm end being slideably engaged with said wand and said second damper arm end being pivotally mounted to said base by said mounting means.

26. The apparatus of claim 25 wherein said means for pivotally mounting said damper includes:

a pivot block having a first through hole receiving said second damper arm end such that said damper arm extends through said pivot block so that said second damper arm end extends therefrom; and means for rotationally mounting said pivot block to said base.

27. The apparatus of claim 26 wherein said damper further includes a gas piston, said gas piston including a first end mounted to said base and a second end from which a piston rod extends, said piston rod being connected with said second damper arm end, whereby when said target is struck by the tennis racket said wand will be moved from its rest position to its displaced position and said damper arm will be pivoted about said means for pivotally mounting said damper, resulting in said piston rod being retracted.

28. A tennis practice apparatus usable by an individual with a tennis racket and on a playing surface to improve his playing skills, said apparatus comprising:

a base;

a target unit including a target for striking by the tennis racket;

a flexible wand having an upper section and a lower section, said lower section being attached to said base, said wand extending upwardly from said base, said wand being able to move between a wand rest position and a wand displaced position in response to said target being struck by the tennis racket, means attaching said target unit to said upper section of said wand;

said base further including a channel, said wand being mounted to said channel;

said channel having an elongate axis and said base further including a pivot bracket mounting said channel for pivotal movement of said channel relative to said bracket, said pivotal movement of said channel being in a plane transverse to said channel elongate axis, whereby said channel may be selectively pivoted so as to dispose said target at selected heights above a playing surface.

29. The apparatus of claim 28 wherein said channel includes an end wall having a substantially semi-circular top side with a plurality of notches disposed along said top side, and said pivot bracket having an end wall, and said practice apparatus further includes a latching apparatus for selectively latching said channel, said latching apparatus including a latch pivotally mounted to said pivot bracket, said latch being pivotable between a latched position wherein said latch engages one of said notches and an unlatched position wherein said latch is disengaged from all of said notches and said channel is free to pivot relative to said pivot bracket.

30. The apparatus of claim 29 wherein said latch apparatus includes a torsion spring for biasing said latch to said latched position, said torsion spring including a first spring end bearing against said latch and a second spring end bearing against said pivot bracket end wall.

31. The apparatus of claim 1 wherein:

said wand further includes a shock body positioned between said lower section of said wand and said upper section of said wand, said shock body being attached to one of said sections of said wand and slidably retaining the other of said sections of said wand to allow said other of said sections of said wand to move relative to said shock body between an upper displaced position and a lower displaced position; and said wand further including biasing means positioned within said shock body to bias said other of said sections of said wand to a rest position intermediate said upper and lower displaced positions and to urge said other of said sections of said wand to said rest position so as to allow said other of said sections of said wand to freely move between said displaced positions when said target is struck by the racket.

32. The apparatus of claim 31 wherein said biasing means includes:

a first spring, a second spring, and a spring collar, said spring collar being attached to one of said sections of said wand;

said first spring extending between and bearing against said shock body and said collar;

said second spring extending between and bearing against said spring collar and the said wand section not attached to said spring collar;

wherein when said target is struck by the tennis racket, said upper section of said wand will be displaced relative to said lower section of said wand, compressing one of said springs and extending the other of said springs.

33. A tennis practice apparatus usable by an individual with a tennis racket to improve his skill in playing the game of tennis, said apparatus comprising:

a base;

a target unit, including a tennis ball for striking by the tennis racket;

a flexible wand having an upper section and a lower section, said lower section being connected to said base, said wand extending upwardly from said base, said wand being able to move between a rearwardly disposed wand rest position and a forwardly disposed wand displaced position in response to said target unit being struck by the tennis racket;

said wand further including a shock body slidably connecting said wand upper section and said wand lower section to allow one of said wand sections to be a slidable wand section slidable relative to the other of said wand sections, said slidable wand section being movable between upper and lower displaced positions from an intermediately positioned rest position;

said wand further including biasing means within said shock body to bias said slidable wand section to said intermediately positioned rest position and to urge said slidable wand section to said intermediately positioned rest position so that said slidable wand section returns to said intermediate rest position after being displaced to said tapper or lower displaced positions;

means attaching said target unit to said upper section of said wand;

said biasing means including a first spring, a second spring, and a spring collar, said first spring extending between and bearing against said shock body and said spring collar, and said second spring extending between and bearing against said spring collar and the other of said wand sections; and wherein when said target unit is struck by the tennis racket, said upper section of said wand will be displaced in relation to said lower section of said wand, extending one of said springs and compressing the other of said springs, said shock body thereby absorbing the shock of the tennis racket hitting said target unit while aiding in simulating the feel of an unencumbered tennis ball.

34. The apparatus of claim 33 and further including a damper for damping movement of said wand generated by said target unit being struck by a tennis racket, said damper extending upwardly from said base and including a damper arm having first and second damper arm ends and further including means for pivotally mounting said damper to said base, said first damper arm end being slidably engaged with said wand and said second damper arm end being pivotally mounted to said base by said mounting means.

35. The apparatus of claim 34 wherein said pivotal mounting means comprises:

a pivot block having a first through hole receiving said second damper arm end such that said damper arm extends through said pivot block so that said second damper arm end extends therefrom; and means for rotationally mounting said pivot block to said base.

36. The apparatus of claim 35 wherein said damper further comprises a gas piston, said gas piston including a first end mounted to said base and a second end from which a piston rod extends, said piston rod being connected to said second damper arm end, whereby when said target unit is struck by the tennis racket said wand will be moved from its said rearwardly disposed rest position to its said forwardly disposed displaced position and said damper arm will be pivoted relative to said base resulting in said piston rod being retracted.

* * * * *